US009240649B2

(12) United States Patent
Battle et al.

(10) Patent No.: US 9,240,649 B2
(45) **Date of Patent: *Jan. 19, 2016**

(54) POWER LINE COUPLER

(71) Applicant: Sicame Australia Pty Ltd, Yatala, QLD (AU)

(72) Inventors: Robert James Battle, Yatala (AU); Pat Pearl, Yatala (AU)

(73) Assignee: SICAME AUSTRAILIA PTY LTD, Yatala, Queensland (AU)

( * ) Notice: Subject to any disclaimer, the term of this patent is extended or adjusted under 35 U.S.C. 154(b) by 197 days.

This patent is subject to a terminal disclaimer.

(21) Appl. No.: 13/919,097

(22) Filed: Jun. 17, 2013

(65) Prior Publication Data

US 2013/0280966 A1 Oct. 24, 2013

Related U.S. Application Data

(63) Continuation-in-part of application No. 13/467,154, filed on May 9, 2012, which is a continuation-in-part of application No. 12/603,287, filed on Oct. 21, 2009, now Pat. No. 8,202,131.

(30) Foreign Application Priority Data

Apr. 29, 2013 (AU) ..... 2013205481

(51) Int. Cl.

| | |
|---|---|
| ***H01R 11/09*** | (2006.01) |
| ***H01R 13/621*** | (2006.01) |
| ***H01R 43/26*** | (2006.01) |
| ***H01R 4/36*** | (2006.01) |

(52) U.S. Cl.

CPC ..... *H01R 13/621* (2013.01); *H01R 4/36* (2013.01); *H01R 11/09* (2013.01); *H01R 43/26* (2013.01); *Y10T 29/49195* (2015.01)

(58) Field of Classification Search

USPC ..... 439/431, 797, 810, 811, 812, 814

See application file for complete search history.

(56) References Cited

U.S. PATENT DOCUMENTS

| | | | | |
|---|---|---|---|---|
| 270,478 | A * | 1/1883 | Pumphrey | 403/206 |
| 1,266,441 | A * | 5/1918 | Finkelstein | 439/797 |
| 1,642,345 | A | 9/1927 | Telford | |
| 3,061,503 | A | 10/1962 | Gould et al. | |
| 3,173,989 | A | 3/1965 | Neaderland | |
| 3,281,524 | A | 10/1966 | Lynch, Jr. et al. | |
| 3,681,512 | A | 8/1972 | Werner et al. | |
| 3,864,013 | A | 2/1975 | Levy | |
| 3,976,385 | A | 8/1976 | Klopfer | |
| 4,079,189 | A | 3/1978 | Troccoli | |
| 4,099,021 | A | 7/1978 | Venezia | |
| 4,269,465 | A | 5/1981 | Mueller | |
| 4,314,093 | A | 2/1982 | Eldridge | |
| 4,829,146 | A | 5/1989 | Duve | |
| 5,137,476 | A | 8/1992 | Noble | |
| 5,332,195 | A | 7/1994 | Sugiyama | |

(Continued)

FOREIGN PATENT DOCUMENTS

| | | |
|---|---|---|
| JP | 10-322828 | 12/1998 |
| WO | 00/54371 | 9/2000 |

*Primary Examiner* — Tho D Ta

(74) *Attorney, Agent, or Firm* — DeLio, Peterson & Curcio, LLC; Kelly M. Nowak

(57) ABSTRACT

The present invention relates to a power line coupler for coupling a pair of cables together. The coupler includes at least one protector for protecting the cables. A clamp is provided for clamping the protector and cables together.

20 Claims, 12 Drawing Sheets

(56) References Cited

U.S. PATENT DOCUMENTS

| | | | | |
|---|---|---|---|---|
| 5,422,438 | A | 6/1995 | Lamome | |
| 5,821,463 | A | 10/1998 | Ngo | |
| 6,042,430 | A * | 3/2000 | Hollick | 439/797 |
| 6,692,285 | B2 * | 2/2004 | Islam | 439/352 |
| 6,875,045 | B1 | 4/2005 | Hollick | |
| 7,394,022 | B2 | 7/2008 | Gumley | |
| 2005/0227522 | A1 * | 10/2005 | Luzzi | 439/181 |
| 2006/0178041 | A1 | 8/2006 | Lund et al. | |
| 2006/0292912 | A1 * | 12/2006 | Bjorklund et al. | 439/266 |
| 2007/0240301 | A1 * | 10/2007 | Johnson et al. | 29/748 |
| 2011/0092112 | A1 | 4/2011 | Battle | |

* cited by examiner

POWER LINE COUPLER

PRIORITY INFORMATION

This application is a continuation-in-part application of U.S. patent application Ser. No. 13/467,154 filed 9 May 2012 which is a continuation-in-part application of and claims priority to U.S. patent application Ser. No. 12/603,287 filed on 21 Oct. 2009, issued as U.S. Pat. No. 8,202,131 on 19 Jun. 2012. This application also claims priority to Australian Patent Application No. 2013205481 filed 29 Apr. 2013

TECHNICAL FIELD

The present invention generally relates to a power line coupler, such as an overhead power line coupler for example.

BACKGROUND

The reference to any prior art in this specification is not, and should not be taken as an acknowledgement or any form of suggestion that the prior art forms part of the common general knowledge.

An overhead power line is an electric power transmission line suspended by towers or poles. Overhead power lines are generally the lowest-cost method of transmission for large quantities of electric power in the range 1 kV to 800 kV. In practice, many overhead power line cables are bare conductors which make them hazardous.

During storms, trees or branches can fall over power lines causing them to break. It is desirable to quickly couple the two separate cables of a broken power line back together so as to remove the hazard, rather than go through the trouble and expense of re-installing a complete power line.

A known power line coupler for coupling a pair of cables together includes a helical conductor which is tightly wound from one cable onto the other. In practice, the repaired and sagging power line can swing in the wind (e.g. during subsequent storms) and the helical conductor can slip from a cable about which it is wound.

Another power line coupler includes a compressible conductor tube for receiving the cables. Once the cables are inserted, the tube can be compressed and deformed so as to clamp the cables therein. However, in practice, the cable thicknesses are prone to variation owing to different manufacturer's specifications. Accordingly, it may be difficult to insert some thicker cables into the tube whereas the tube may be inadequately clamped to other thinner cables which can make the joint susceptible to breakage once again.

SUMMARY OF THE INVENTION

According to one aspect of the present invention, there is provided a power line coupler for coupling a pair of cables together, the coupler including:

at least one protector for protecting the cables; and a clamp for clamping the protector and cables together.

Each protector may include a protection member for protecting a cable from a fastener. The protection member may be formed from deformable aluminum and/or the inner coupler may be coated with a friction enhancing compound to impede extraction of the cables. The coupler may include one or more inner protrusions about which said cables can be bent. The protrusions may be located on one side of the coupler and fasteners may be located on the other side of the coupler.

In use, each cable may be corrugated and resist extraction from the clamp. The clamp may include alternately disposed fasteners. The fasteners may be alternately disposed on the same side of the clamp. The clamp may include fasteners, each fastener including a head from which a threaded shaft extends, the head defining a recess such that a tip of the head can be separated from the fastener by shearing. The tip may include a base shelf for impeding tool slippage when separating the tip.

The power line coupler may further include a locator extending through the protector and against which the cables inserted from opposite sides of the coupler can be located. The clamp may include a tube and one or more endcaps for capping the tube.

According to another aspect of the present invention, there is provided a clamp for a power line coupler, the clamp including: protrusions; and fasteners for fastening to electrically couple a pair of cables together and bend the cables about the protrusions to impede extraction of the cables.

The clamp may further include a protector for locating between the fasteners and the cables. The cables may engage with the protrusions. The fasteners and protrusions may be alternately arranged along the clamp. The fasteners may be alternately arranged from side to side along the clamp.

According to another aspect of the present invention, there is provided a power line coupler for coupling a pair of cables together, the coupler including:

protector means for protecting the cables; and clamp means for clamping the protector means and cables together.

According to another aspect of the present invention, there is provided a power line coupling method for coupling a pair of cables together, the method including the step of:

clamping at least one protector and cables together.

The step of clamping may involve separating a tip of fasteners by shearing.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENT(S)

Figure 1:
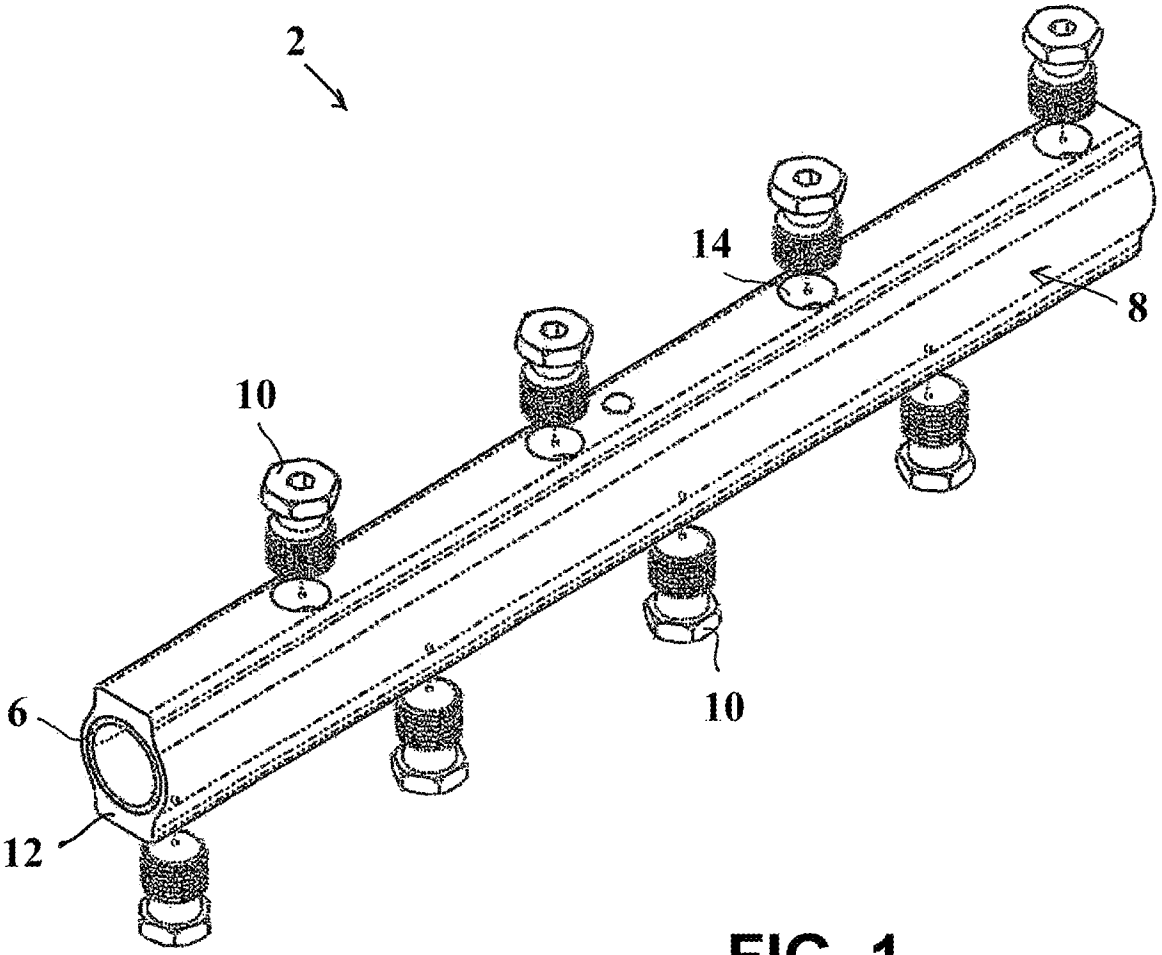
FIG. 1 is a perspective view of an overhead power line coupler.
Figure 2:
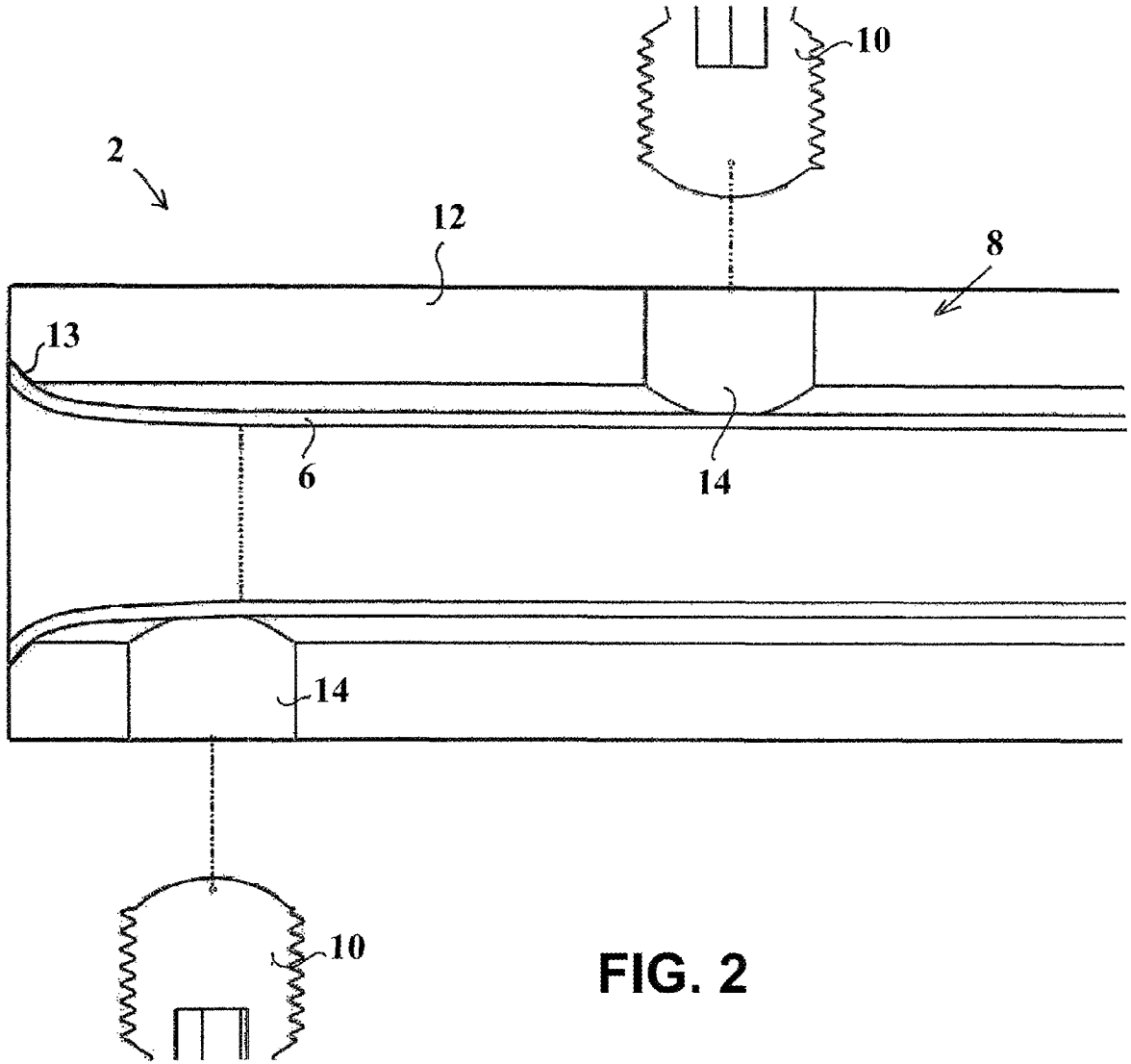
FIG. 2 is a partial side sectional view of the power line coupler of FIG. 1.
Figure 3:
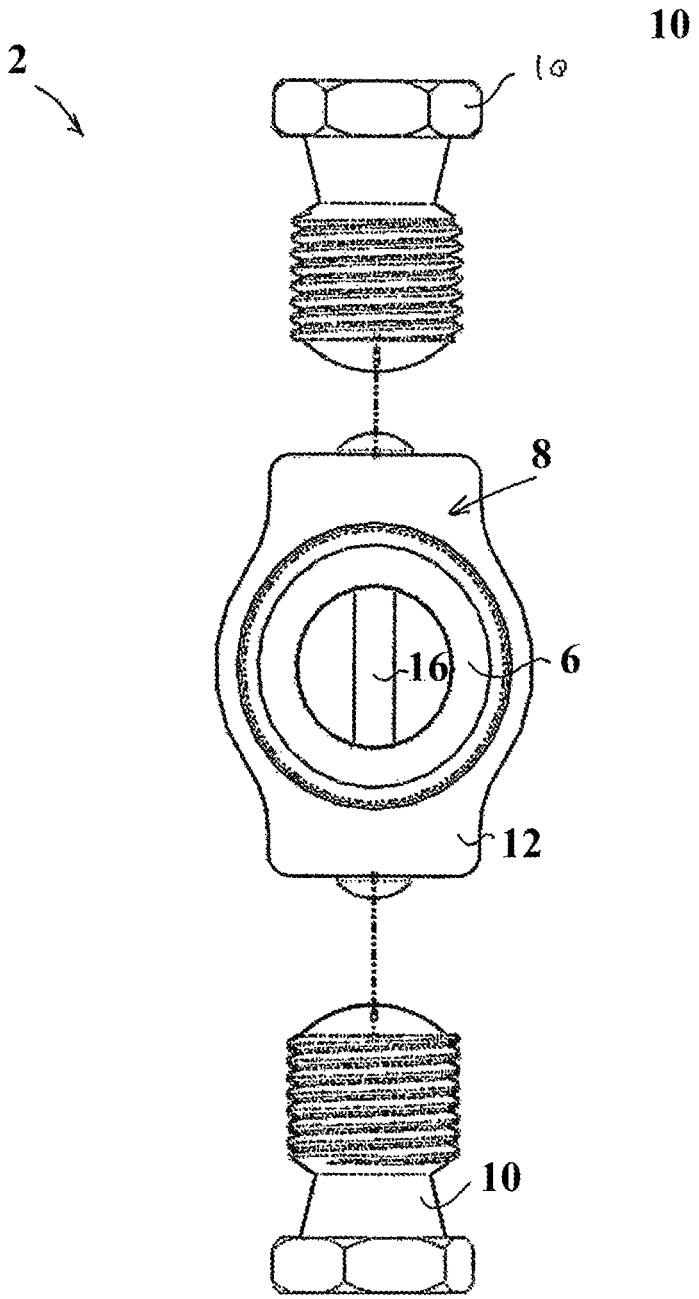
FIG. 3 is an end view of the power line coupler of FIG. 1.

There is provided an overhead power line coupler 2 as shown in FIGS. 1 to 3. The power line coupler 2 is suitable for electrically coupling a pair of cables 4*a*, 4*b* together as shown in FIG. 4.

Turning firstly to FIG. 1, the coupler 2 includes a tubular protector 6 for receiving and protecting the cables 4 from damage by the base of clamp fasteners 10. A tubular clamp 8 can be used to clamp the protector 6 and cables 4 together so that the cables 4 are coupled together and resist slipping from the protector 6.

Figure 4:
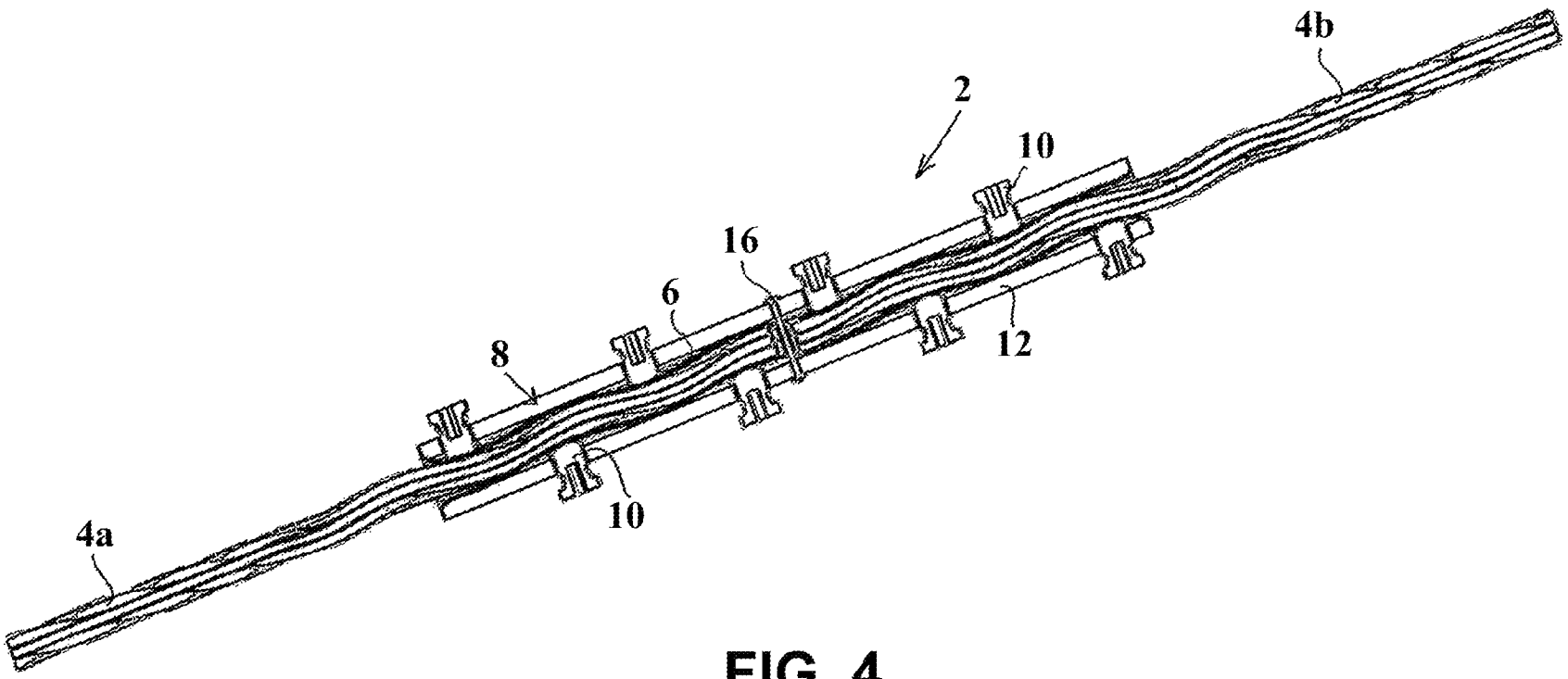
FIG. 4 is a side sectional view of the power line coupler of FIG. 1 coupling a pair of cables together.

The protector 6 is in the form of an inner tube in which the cables 4*a*, 4*b* can be inserted from opposite sides (FIG. 4). To facilitate insertion of the cables 4, the protector 6 includes an inner lubricant in the form of grease. As can best be seen in FIG. 2, the protector 6 widens at both ends so as to be retained within the clamp 8. The protector 6 is formed from deformable aluminum and becomes corrugated (or undulates) when clamped so as to further resist extraction from the clamp 8.

The clamp 8 includes an outer tube 12 in which the protector 6 is located. The outer tube 12 includes threaded holes 14 in which respective fasteners 10 can be engaged. The clamp 8 includes the fasteners which each take the form of a bolt. The outer tube 12 is formed from comparatively durable aluminum and has chamfered or beveled inner edges 13 which engage with the widened ends of the protector 6.

As can best be seen in FIG. 3, the coupler 2 further includes a pin 16 extending through the protector 6 and clamp 8. The pin 16 holds the protector 6 within the clamp 8 and further provides a stop against which the cables 4 can be positioned when fully inserted in the coupler 2.

The method for coupling a pair of cables 4*a*, 4*b* of a broken power line together with the coupler 2 is described in detail below.

Initially, the cables 4*a*, 4*b* are inserted within opposite ends of the protector 6.

The clamp 8 is clamped onto the protector 6 so that the protector 6 and cables 4*a*, 4*b* are clamped together. Elaborating further, the fasteners 10 are tightened which, in turn, deforms the protector 6. As previously explained, the protector 6 protects the strands of each cable 4 from damage during tightening of the fasteners 10.

The cables 4 can be firmly held within the protector 6, irrespective of their diameter. Each of the aluminum protector 6, clamp 8 and fasteners 10 are electrically conductive so that the cables 4*a*, 4*b* are electrically coupled together.

Typically, the cables 4*a*, 4*b* are bare (i.e. not insulated). In one embodiment, insulation can instead be stripped from the ends of the cables 4*a*, 4*b* prior to coupling them together.

Figure 5:
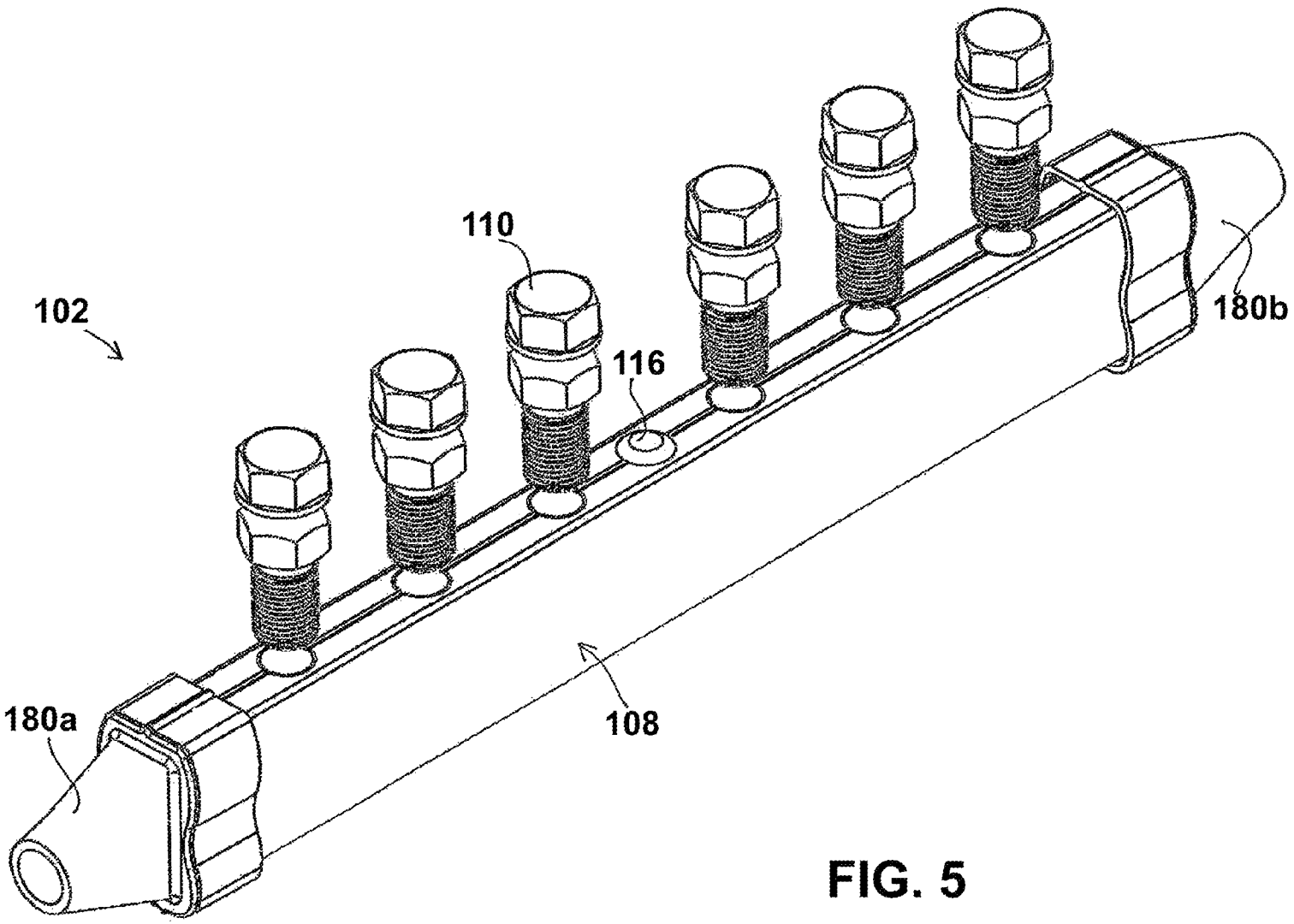
FIG. 5 is a perspective view of an overhead power line coupler in accordance with an embodiment of the present invention.
Figure 6:
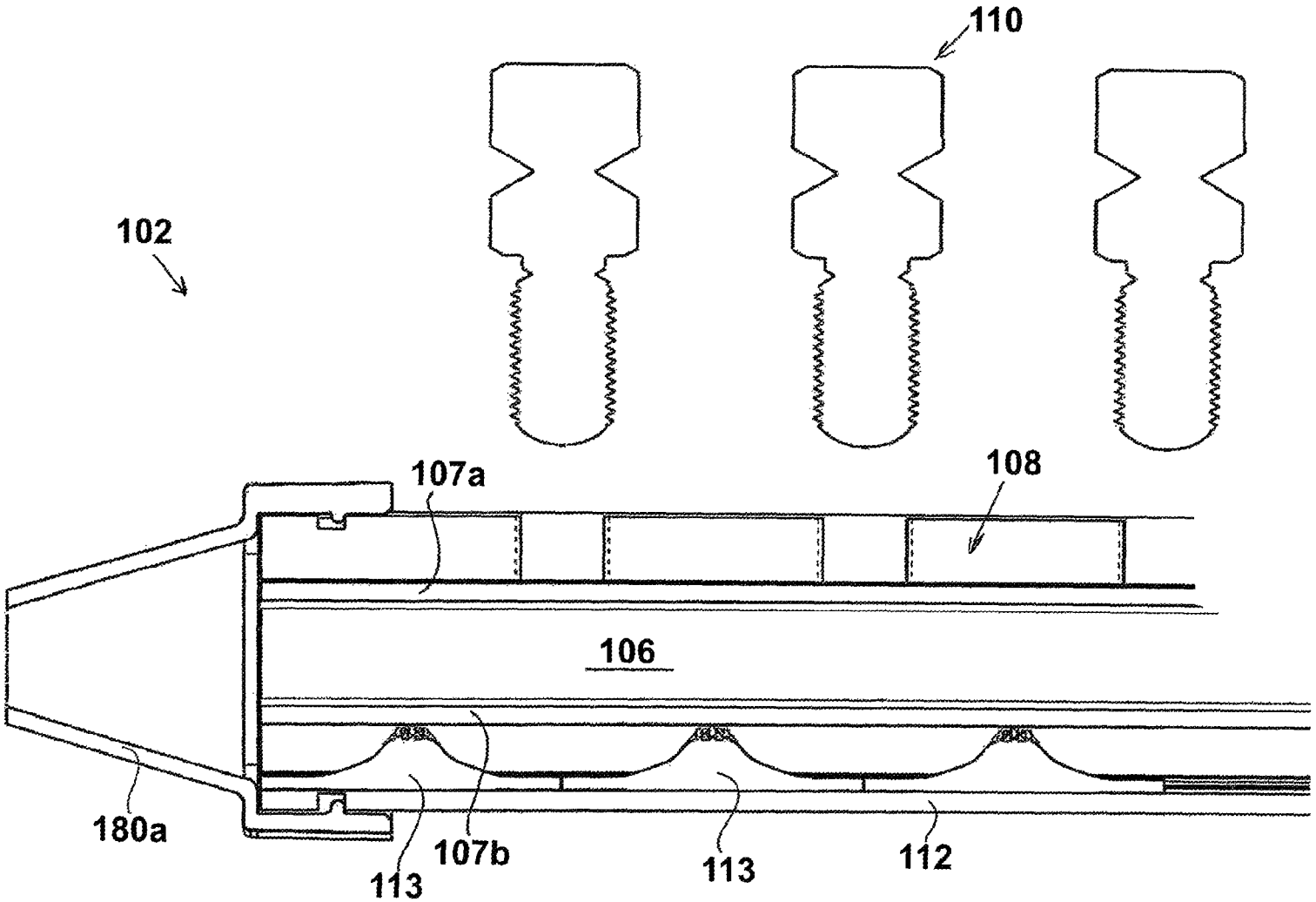
FIG. 6 is a partial side sectional view of the power line coupler of FIG. 5.
Figure 7:
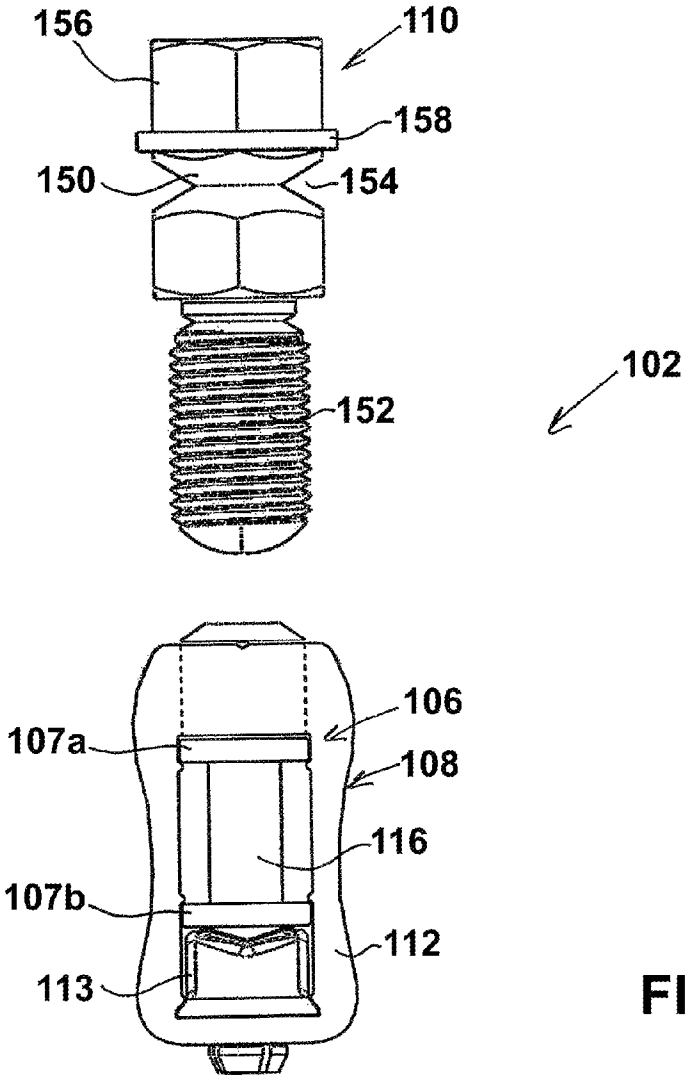
FIG. 7 is an end view of the power line coupler of FIG. 5.

According to an embodiment of the present invention, there is provided an overhead power line coupler 102 shown in FIGS. 5 to 7 for coupling a pair of cables 104*a*, 104*b* together.

As can best be seen in FIGS. 6 and 7, the coupler 102 includes an inner protector 106 for receiving and protecting the cables 104. The protector 106 includes a pair of protection members 107*a*, 107*b*, in the form of aluminum plates, between which the cables 104 can be received. The coupler 102 further includes an outer clamp 108 for clamping the protector 106 and cables 104 together.

The protection members 107*a*, 107*b* are coated on their inwardly faces with a friction enhancing compound (e.g. carborundum) to impede extraction of the cables 104. Advantageously, the friction enhancing compound reduces the clamping torque required to hold the cables 104.

Figure 8:
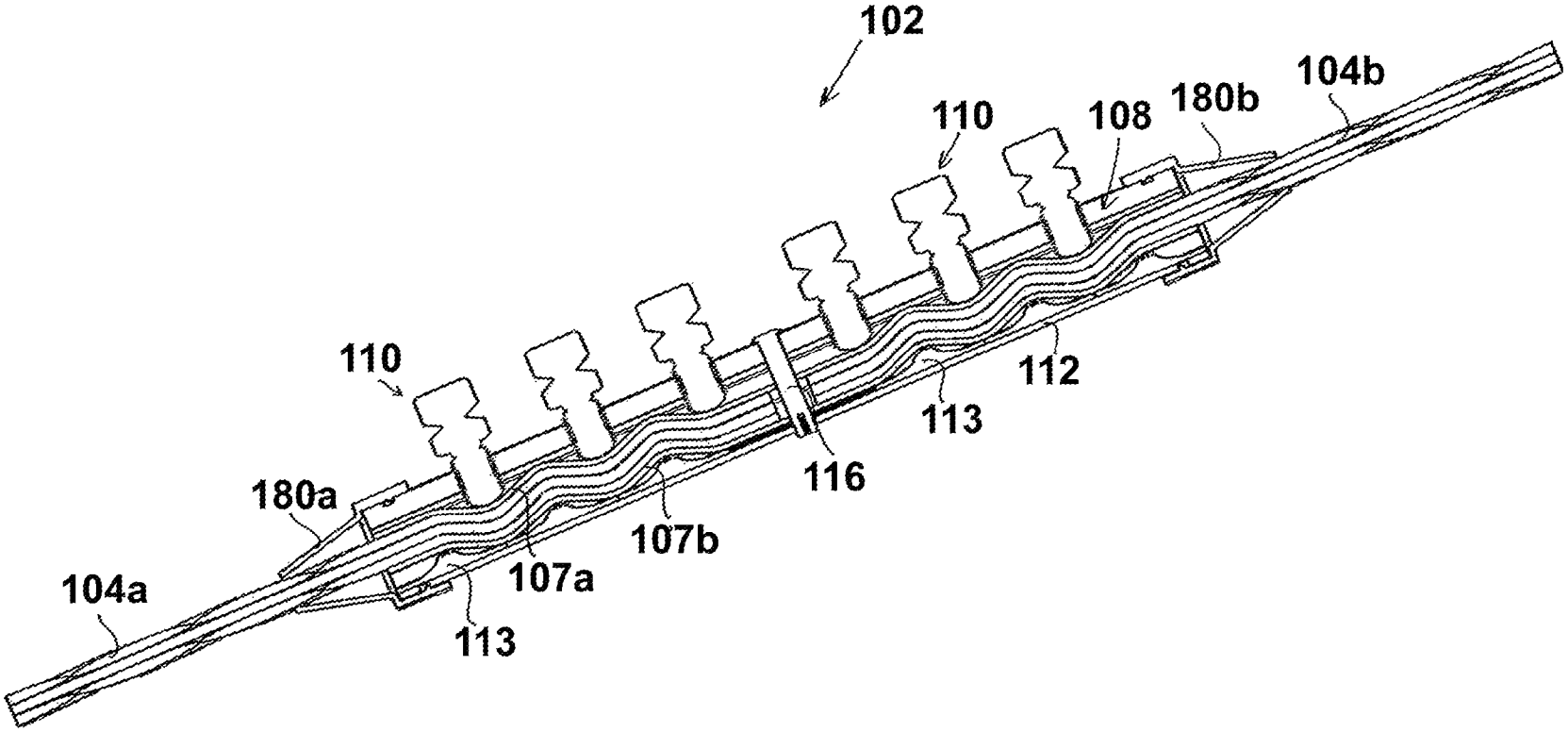
FIG. 8 is a side sectional view of the power line coupler of FIG. 5 coupling a pair of cables together.

The clamp 108 includes an outer tube 112 in which the protector 106 is located. The clamp 108 further includes a plurality of inner protrusions 113 force-fitted by sliding into a slot in the bottom of the tube 112. The protrusions 113 are formed from aluminum or brass, and located on a lower side of the coupler 102. Fasteners 110 in the form of shear bolts are located on the upper side of the coupler 102. As can best be seen in FIG. 8, the protrusions 113 and fasteners 110 are alternatingly disposed so that, in use, the protector 106 and cables 104 are corrugated and resist extraction from the clamp 108.

Turning to FIG. 7, each aluminum fastener 110 includes a head 150 from which a threaded shaft 152 extends. The head 150 defines a recess 154 such that a hexagonal tip 156 of the head 150 can be separated from the fastener 110 by shearing with a spanner. The tip 156 includes a base shelf 158 for impeding spanner (wrench, shifter or other tool) slippage to the hexagonal base 160 of the head 150 when separating the tip 156.

In use, the spanner is used to preliminarily tighten each fastener 110 until each tip 156 separates so that the cables 104 are held under preliminary pressure in an undulating or corrugated manner. Thereafter, the spanner is used to further tighten each base 160 (and place the cables 104 under greater pressure) until each base 160 separates from its threaded shaft 152 so that no part of the fastener 110 remains protruding from the clamp 108. This two-step tightening approach impedes excessive stresses on the cables 104.

The power line coupler further includes a plastic pin locator 116 extending through the center of the tube 112 and protector 106, and against which the cables 104 inserted from opposite sides of the coupler 102 can be located. The locator 116 clips or snap-fits into the tube 112 and has a split tail with projections to impede removal.

The clamp 108 also includes a pair of plastic endcaps 180*a*, 180*b* for capping the tube 112. Each cap 180 defines an internal rib or tongue for snap engaging within an endless outer groove defined in the tube 112.

According to another embodiment of the present invention, there is provided an overhead power line coupler 202 shown in FIGS. 9 to 12 for coupling a pair of cables 104*a*, 104*b* together. Like reference numerals refer to like features previously described.

Figure 9:
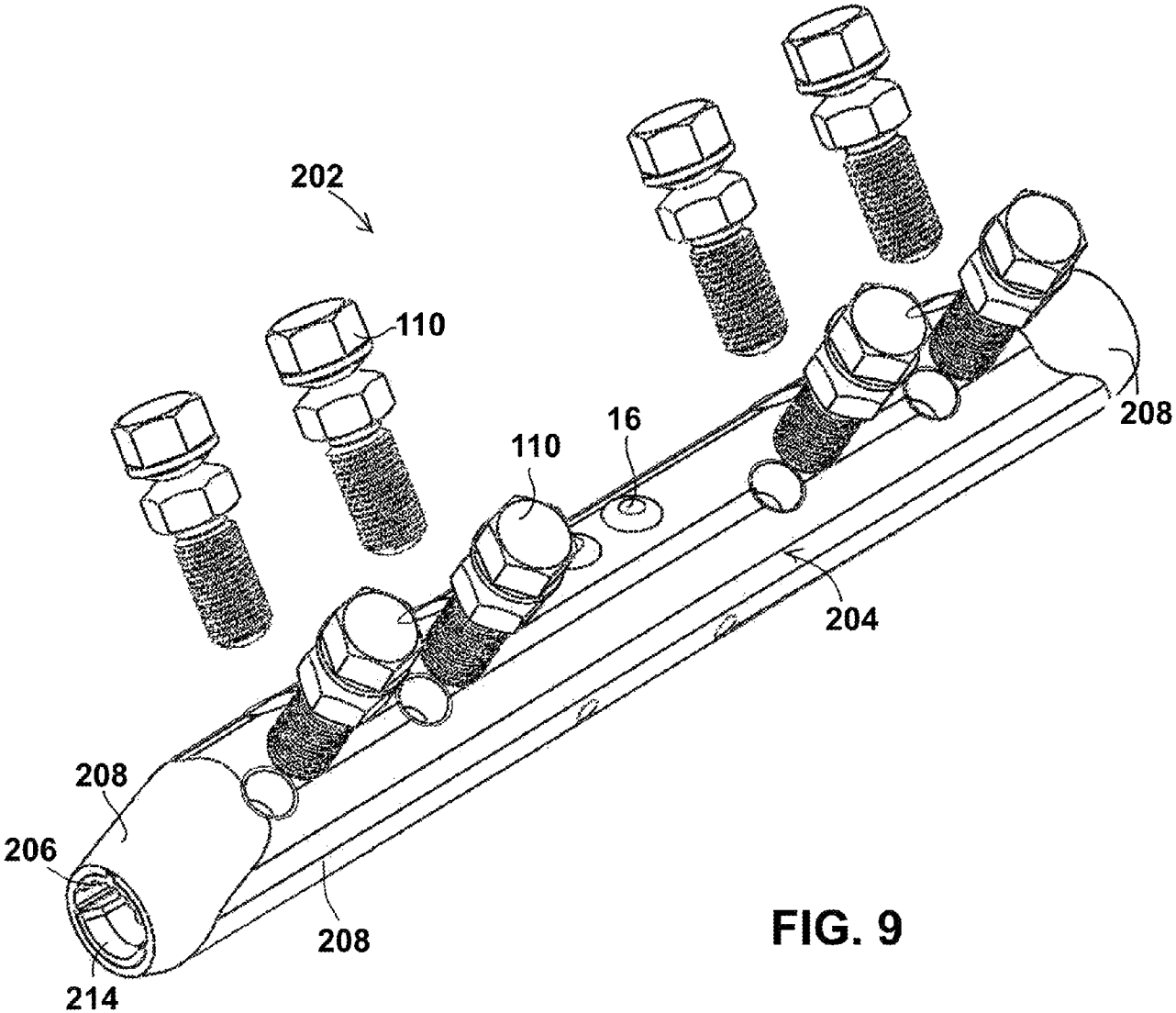
FIG. 9 is a perspective upper view of an overhead power line coupler in accordance with an embodiment of the present invention.

Turning to FIG. 9, the coupler 202 includes a clamp 204 including alternatingly disposed fasteners 110 that longitudinally alternate between left and right sides of the clamp 204.

Figure 10:
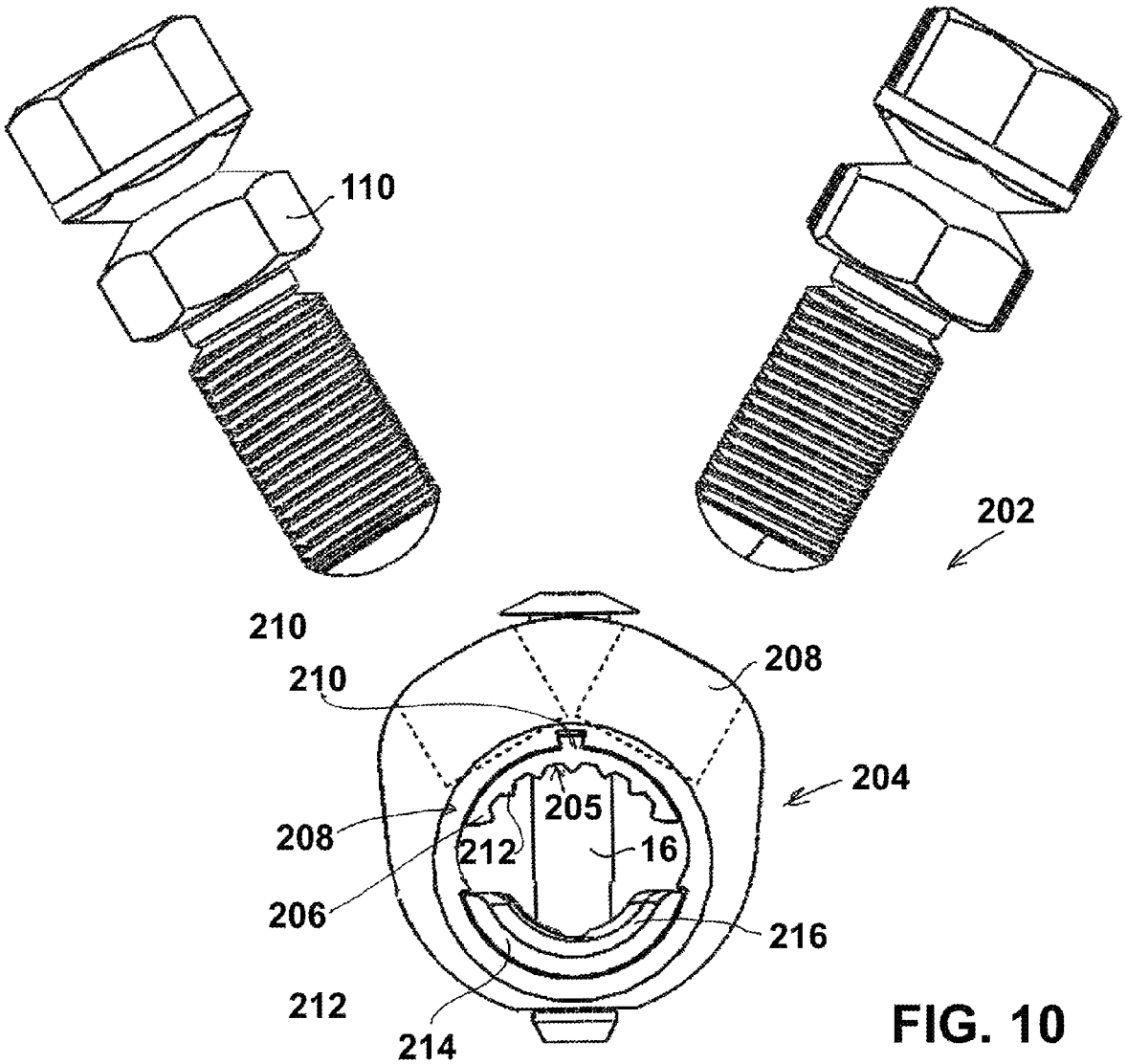
FIG. 10 is an end view of the overhead power line coupler of FIG. 9.
Figure 11:
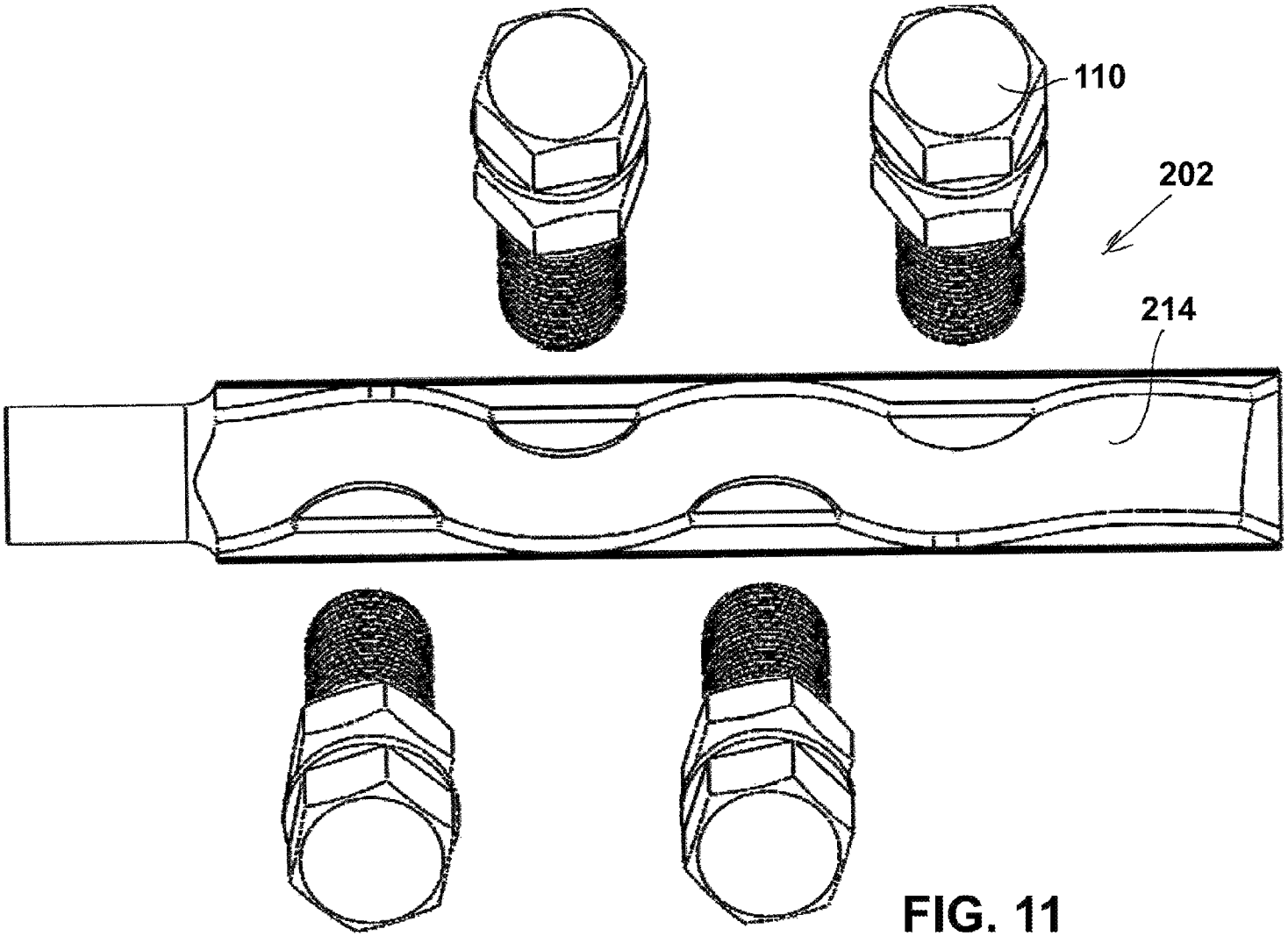
FIG. 11 is a partial plan sectional view of the overhead power line coupler of FIG. 9.
Figure 12:
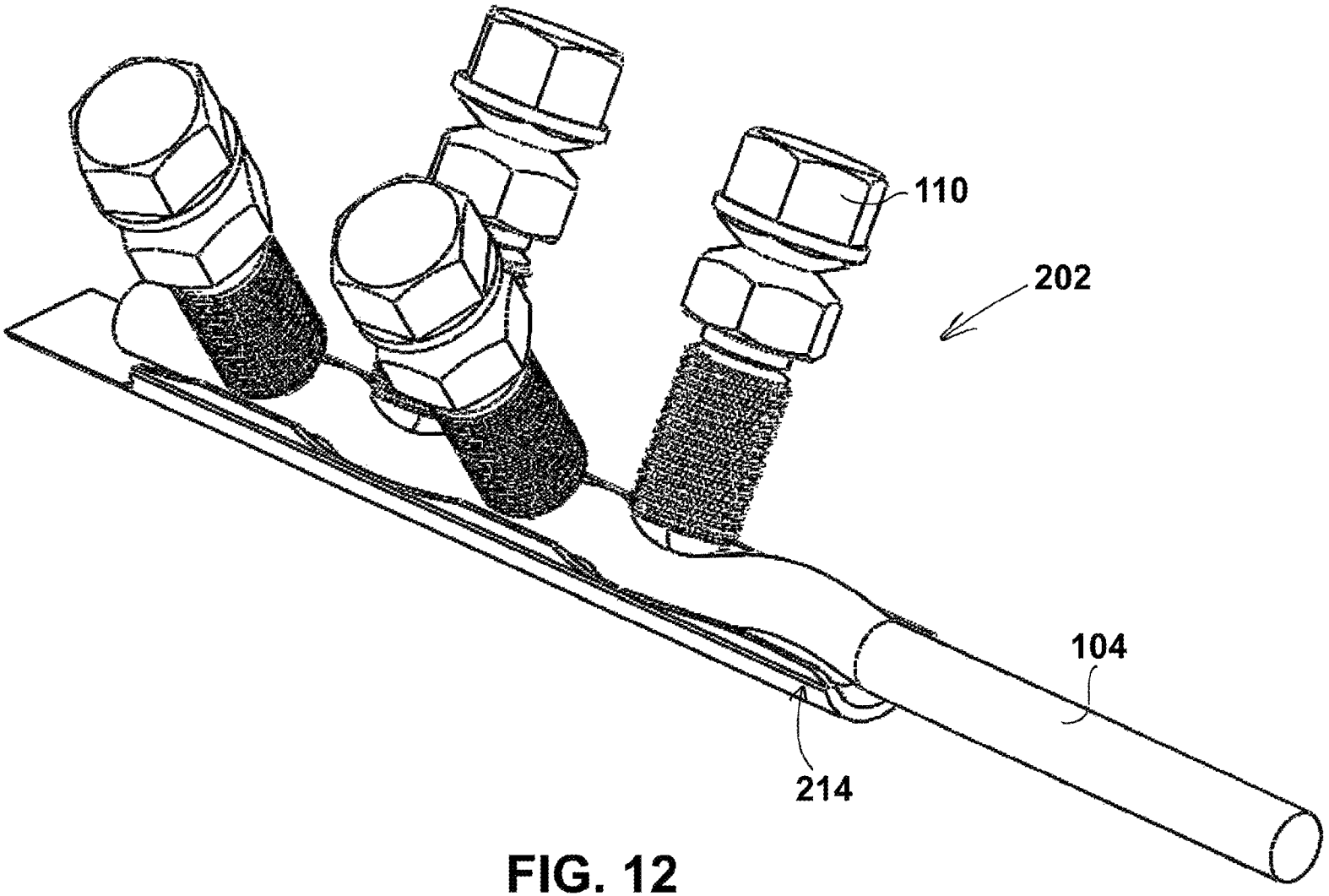
FIG. 12 is a partial perspective sectional view of the overhead power line coupler of FIG. 9.

As can best be seen in FIG. 10, the clamp 204 includes an outer tube 208 through which the threaded fasteners 110 pass. An upper curved cable protector 205 is provided along the ceiling of the tube 208 for receiving and protecting the cables 104 from the fasteners 110. The protector 205 includes a pair of protection members 206 in tube 208 in the form of aluminum plates, for receiving respective cables 104 on either side of the central cable stop pins 16. Each extruded protection member 206 fits into the ceiling of the tube 208 with a dovetail joint 210. Furthermore, each extruded protection member 206 has a plurality of longitudinally extending cable engaging teeth 212.

The coupler 202 further includes a pair of curved floor plates 214 for receiving respective cables 104 on either side of the central cable stop pins 16. Each floor plate 214 is fitted in position within a respective alcove defined in the internal floor of the tube 208. Each floor plate 214 includes inwardly extending spaced apart transverse rib protrusions 216 which engage directly with the cable 104.

The fasteners 110 and protrusions 216 are alternately arranged along the top and bottom of the coupler 202 so that the fasteners 110 impact upon protection members 206 to push the cable 104 into space between adjacent protrusions 216. Furthermore, as can best be seen in FIGS. 11 and 12, the fasteners 110 are alternately arranged from side to side along the coupler 202. In this manner, the tightened fasteners 110 clamp the upper deformed protector members 206 and cables 104 together so that the cables 104 become corrugated in two dimensions, when viewed from both above (FIG. 11) and the side (FIG. 12), which effectively impedes withdrawal of the cables 104 from the coupler 202.

A person skilled in the art will appreciate that many embodiments and variations can be made without departing from the ambit of the present invention.

The coupler 2 above included a single protector 6 and a single clamp 8. Alternatively, the coupler may instead include a protector means including two or more protectors. In yet another scenario, the coupler may instead include a clamp means including two or more clamps.

The skilled person will appreciate that the dimensions of the protector 6 and clamp 8 can be varied to suit the dimensions of the cables 4. Furthermore, the number of fasteners 10 for the clamp 8 can be varied and increase with increasing cable diameter.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

The claims defining the invention are as follows:

1. A power line coupler for coupling a pair of cables together, the coupler including:

at least one protector for protecting the cables;

a clamp for clamping the protector and cables together; and one or more inner protrusions about which said cables can be bent and which do not intrude inside the cable, none of said inner protrusions cutting into said cables, the one or more inner protrusions for retaining the cables inside the coupler.

2. A power line coupler as claimed in claim 1, wherein each protector includes a protection member for protecting a cable from at least one fastener.

3. A power line coupler as claimed in claim 2, wherein the protection member is formed from deformable aluminum and/or the protection member is coated with a friction enhancing compound to impede extraction of the cables.

4. A power line coupler as claimed in claim 1, further including:

a first surface having a plurality of inner protrusions comprising peaks separated by recesses, and a second surface having plurality of openings for receiving a plurality of clamps, whereby the clamps extend into the recesses of the first surface, and together the plurality of inner protrusions and plurality of clamps corrugate a cable residing therebetween so that the cable resists extraction from the clamp.

5. A power line coupler as claimed in claim 1, wherein the protrusions are located on one side of the coupler and fasteners are located on the other side of the coupler.

6. A power line coupler as claimed in claim 1, wherein, in use, each cable is corrugated and resists extraction from the clamp.

7. A power line coupler as claimed in claim 1, wherein the clamp includes alternately disposed fasteners.

8. A power line coupler as claimed in claim 7, wherein the fasteners are alternately disposed on the same side of the clamp.

9. A power line coupler as claimed in claim 1, wherein the clamp includes fasteners, each fastener including a head from which a threaded shaft extends, the head defining a recess such that a tip of the head can be separated from the fastener by shearing.

10. A power line coupler as claimed in claim 9, wherein the tip includes a base shelf for impeding tool slippage when separating the tip.

11. A power line coupler as claimed in claim 1, further including at least one locator extending through the protector and against which the cables inserted from opposite sides of the coupler can be located.

12. A power line coupler as claimed in claim 1, wherein the clamp includes a tube and one or more endcaps for capping the tube.

13. A clamp for a power line coupler, the clamp including:

a plurality of inner protrusions about which said cables can be bent and which do not intrude inside the cable, none of said inner protrusions cutting into said cables, the inner protrusions retaining the cables inside the coupler; and fasteners for fastening to electrically couple a pair of cables together and bend the cables about the protrusions to impede extraction of the cables.

14. A clamp as claimed in claim 13, further including a protector for locating between the fasteners and the cables.

15. A clamp as claimed in claim 14, wherein the cables engage with the protrusions.

16. A clamp as claimed in claim 13, wherein the fasteners and protrusions are alternately arranged along the clamp.

17. A clamp as claimed in claim 13, wherein the fasteners are alternately arranged from side to side along the clamp.

18. A power line coupler for coupling a pair of cables together, the coupler including:

protector means for protecting the cables;

clamp means for clamping the protector means and cables together; and one or more inner protrusions about which said cables can be bent and which do not intrude inside the cable, the one or more inner protrusions for retaining the cables inside the coupler whereby said power line coupler forces said cables into up and down, as well as side to side, wave patterns to enable said power line coupler to provide a full mechanical tension connection ensuring that the power line coupler does not affect the breaking load of the cables.

19. A power line coupling method for coupling a pair of cables together, the method including the step of:

clamping at least one protector and cables together about one or more inner protrusions about which said cables are bent and which do not intrude inside the cable, whereby the inner protrusions retain the cables inside the coupler without intruding inside the cable, the power line coupler forcing said cables into up and down, as well as side to side, wave patterns to enable said power line coupler to provide a full mechanical tension connection ensuring that the power line coupler does not affect the breaking load of the cables.

20. A power line coupling method as claimed in claim 19, wherein the step of clamping involves separating a tip of fasteners by shearing.

* * * * *